US005304068A

United States Patent [19]

Welch

[11] Patent Number: 5,304,068

[45] Date of Patent: Apr. 19, 1994

[54] GROUND FAULT INTERRUPTOR ELECTRICAL CONNECTOR FOR TWIST-LOCK PLUG

[75] Inventor: John Welch, South Windsor, Conn.

[73] Assignee: William C. Welch, South Windsor, Conn.

[21] Appl. No.: 980,264

[22] Filed: Nov. 23, 1992

[51] Int. Cl.[5] ..... H01R 13/652

[52] U.S. Cl. ..... 439/106; 361/45

[58] Field of Search ..... 439/106, 649, 620, 673; 361/45, 49

[56] References Cited

U.S. PATENT DOCUMENTS 4,079,344 3/1978 Lauben et al. ..... 439/106 X 4,084,203 4/1978 Dietz et al. ..... 361/45

*Primary Examiner*—Eugene F. Desmond

*Attorney, Agent, or Firm*—McCormick, Paulding & Huber

[57] ABSTRACT

A ground fault interruptor (GFI) electrical connector receptacle device for use with a twist-lock, multi-prong plug has passages in the face plate in registration with electrical contact blades coupled to a GFI circuit to disconnect the blades upon detection of a ground fault. The configuration and shape of the passages through the face plate accept the twist-lock plug so that the foot of the L-shaped grounding prong of the plug is brought into engagement with the rear surface of the housing face plate when the plug is rotated to restrain the plug from axial removal.

1 Claim, 1 Drawing Sheet

GROUND FAULT INTERRUPTOR ELECTRICAL CONNECTOR FOR TWIST-LOCK PLUG

BACKGROUND OF THE INVENTION

The present invention relates generally to electrical connectors of the general type having holes for receiving a multi-prong plug to transfer a source of electrical power to the plug and an electrical device attached thereto and relates more specifically to a ground fault interruptor (GFI) electrical connector for use with a twist-lock multi-prong plug.

National and local electrical building codes require that electrically operated devices such as hot tub and swimming pool pumps, electric hedge clippers, electric lawnmowers, and so forth, and electrical outlets in marina locations be coupled to the source of electrical power by means of a twist-lock plug. In addition, the electrical code requires that the electrical power supplied to such a tool or electrically operated device be protected by a ground fault interruption circuit. Currently, compliance with the electrical code requirements necessitates that on electrical circuit breaker having a ground fault circuit interruption capability be mounted at the electrical distribution panel which is often generally located some distance from the actual operation of the electrically powered device to be protected. Accordingly, the electrical power is brought to the desired location through means of a electrical conduit and is then terminated at the twist-lock electrical connector. Accordingly, two separate and distinct electrical code requirement devices are necessary to comply with the electrical code requirements.

Another disadvantage to known methods and arrangements for complying with the electrical code requirements is related to the necessity, particularly when it is desired to use such tools and electrically operated equipment in already wired buildings, residences, or other facilities wherein pre-wiring is often difficult or impractical.

It is desirable therefore to provide a single, electrical connector receptacle device which can be used with a twist-lock multi-prong plug while providing the desired protection by means of a ground fault interruption circuit with the single protective device being located near or at the location that the electrically operated device is used.

It is further desirable that such an electrical connector device be usable with existing electrical wiring and physically mountable within a conventional electrical outlet box.

It is a general aim of the present invention therefore to provide a ground fault interruption electrical connector receptacle device for use with a twist-lock, multi-prong plug.

SUMMARY OF THE INVENTION

In accordance with the present invention, a ground fault interruption (GFI) electrical connector receptacle device for use with a twist-lock, multi-prong plug eliminates the need for two separate and distinct safety code devices currently necessary to comply with national electrical code requirements when electrical power is supplied to electrically operated devices such as outdoor tools, swimming pools, hot tubs and the like. The device includes a rectangularly shaped housing for carrying ground fault circuit interruption circuit means and a plurality of blades arranged circumaxially in a spaced relationship separated by 120° from an adjacent blade. A face plate covers the housing and has passages therethrough and each is in registration with one of the blades for axially receiving a corresponding prong of a twist-lock plug. One of the passages is L-shaped to accommodate a corresponding L-shaped grounding prong on the plug. The prongs of the twist-lock plug are in electrical and physical contact with the blades when the plug is axially inserted and is retained by the device when the twist-lock plug is rotated such that the foot of the L-shaped prong is in engagement with the rear surface of the face plate. The non-grounded blades are electrically coupled to the load side of the GFI circuit means and are disconnected therefrom in response to the detection of a ground fault.

BRIEF DESCRIPTION OF THE DRAWINGS

Other features and advantages of the present invention will become more apparent from the following description and claims and from the accompanying drawings wherein:

DETAILED DESCRIPTION OF PREFERRED EMBODIMENTS

Figure 1:
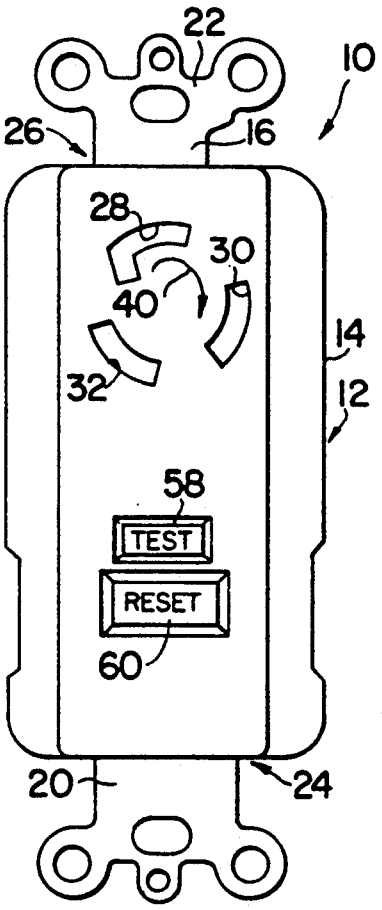
FIG. 1 is a front view of a ground fault interruptor (GFI) twist-lock electrical connector receptacle device embodying the present invention.

Referring now to the drawings in detail wherein like reference numerals indicate like elements, FIG. 1 illustrates a front view of a ground fault interruptor (GFI) twist-lock electrical receptacle or socket embodying the present invention and is generally designated 10. The receptacle 10 includes a housing generally designated 12 having a removable front face plate 14. The housing 12 is generally of a plastic or bakelite insulating material known to those skilled in the art. The housing is carried by a metal grounding strap 16 having tabs 20,22 which extend beyond the housing at either ends 24,26 of the housing. The tabs 20,22 of the metal strap have holes or other means used for mounting the electrical connector receptacle device within an electrical service outlet box and are of the configuration well known to those in the art.

The front face plate 14 is arranged with passages or holes 28, 30, 32 therethrough and having a shape for providing access to and physical and electrical connection to blades 34, 36 and 40 which receive corresponding prongs on a twist-lock plug. The holes 28, 30, 32 are arranged in a circumaxial relationship with one another and spaced 120° from one another in conformance with standards set by the national electrical code. As shown, hole 28 in the face plate 14 is L-shaped to receive the ground prong of a twist lock plug and is in registration with the blade 34. The hole 30 is in registration with the blade 36 and corresponds to the neutral or white lead and the opening 32 is in registration with the blade 38 and corresponds to the hot or black lead in commercial electrical service. The arrangement of the passages or holes 28, 30, 32 conforms to the electrical code and provides a "polarized' electrical connection to the prongs of the a twist-lock plug inserted therein. The prongs of the twist-lock plug are axially inserted into the electrical connector receptacle through the openings 28, 30, 32 until the prongs are gripped by the blades 34, 36 and 38, respectively. The twist-lock plug is then rotated in the clockwise direction indicated by the arrow 40 so that the foot of the L-shaped prong is in engagement with the rear surface of the front plate 14 thereby preventing the twist-lock plug from being removed axially.

Figure 2:
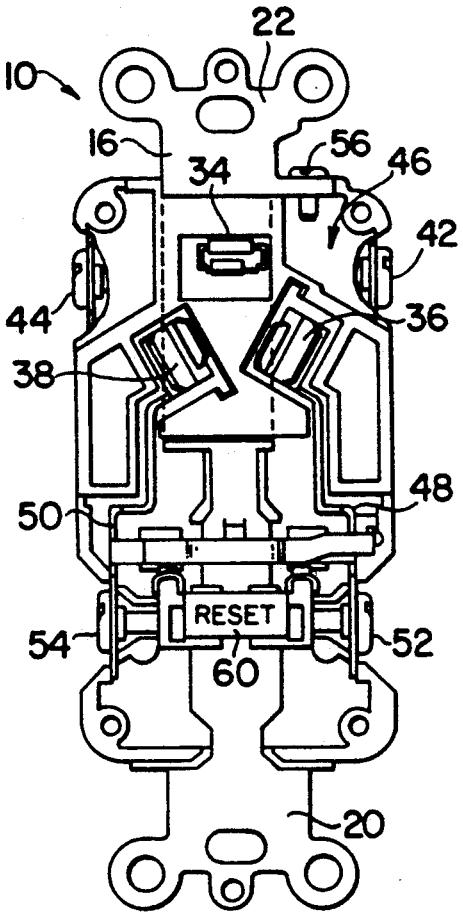
FIG. 2 is a front view of the GFI twist-lock electrical connector receptacle device of FIG. 1 with the front face cover removed to reveal the blades of the twist-lock connector and GFI electrical circuit board.

The operation of a ground fault interruptor circuit is well understood by those skilled in the art and numerous techniques and circuitry are available to perform the ground fault interruption function. It is sufficient for purposes of this disclosure to note that the line-side supply is coupled to the electrical connector receptacle device 10 by means of terminal screws 42,44 corresponding to the neutral and hot leads from the commercial electrical supply. The ground fault interruption circuitry components are coupled to the terminal screws 42,44 and are carried on a circuit board indicated generally 46. The blades 36,38 are connected to the ground fault circuitry via the contact elements 48,50, respectively. As illustrated in FIG. 2, the electrical connector receptacle device 10 provides a ground fault interruption protected load connection via the terminal screws 52,54 which are electrically and physically connected to the contact tabs 48,50, respectively. In the embodiment illustrated in FIG. 2, the GFI twist-lock electrical connector receptacle device provides protection not only for the twist-lock plug but also for any other electrical outlets wired to the load side of the GFI electrical connector receptacle device.

The blade 34 is connected to the metal strap 16 by means of riveting or other appropriate mechanical and electrical connection as is known to those skilled in the art. A third wire or green wire ground connection is also provided via the ground terminal screw 56 in conformance with the national electrical code.

The GFI electrical receptacle of the present invention also includes a test button 58 and reset button 60 for testing and resetting the GFI electrical connector receptacle device and their respective functions are well understood and known by those skilled in the art and no further explanation is necessary for the purposes of this disclosure.

A ground fault interruptor twist-lock electrical connector receptacle device has been described above to accommodate a specifically designed twist-lock plug. It will be recognized that there are a number of differently styled twist-lock plugs that may be used with the concept of the present invention without departing from the spirit and scope of the invention. Numerous changes and modifications may be made by those skilled in the art in view of the foregoing and therefore the invention has been described by way of example rather than limitation.

The invention claimed is:

1. A ground fault interruption (GFI) electrical connector receptacle device for use with a twist-lock, multi-prong plug, said device comprising:

a housing having ground fault interruption circuit means responsive to the detection of a ground fault said ground fault interruption circuit means having first terminal means defining an input power side and second terminal means defining a load side;

a plurality blades circumaxially arranged and carried by said housing in a spaced relationship with respect to one another, each of said blades being located along a radial line separated by 120° from a radial line passing through an adjacent one of said blades;

grounding strap means for carrying and mounting said housing in an electrical outlet service box;

a first one of said blades being electrically and physically coupled to said grounding strap;

a second one of said blades being electrically and physically coupled to one line of the load side of said GFI circuit means;

a third one of said blades being electrically and physically coupled to a second line of the load side of said GFI circuit means, said second and third blades being electrically disconnected from said GFI circuit means in response to said GFI circuit means detecting a ground fault;

said housing having a face plate with a plurality of passages therethrough and each in registration with said one of said plurality of blades, one of said passages in registration with said first blade being L-shaped for axially receiving a correspondingly shaped grounding prong of a twist-lock plug, said second and third passages being in registration with said second and third blades, respectively; said blades providing an electrical and physical connection to respective prongs of a twist-lock plug axially inserted through said passages and received within said blades, said respective prongs of said twist-lock plug being retained within said respective corresponding blades when said twist-lock plug is rotated so as to engage a portion of said L-shaped prong with the rear surface of said face plate.

* * * * *